US011339539B2

(12) United States Patent
Valkealaakso et al.

(10) Patent No.: US 11,339,539 B2
(45) Date of Patent: May 24, 2022

(54) POLYMER PRODUCT FOR IMPROVING RETENTION OF HYDROPHOBIC INTERNAL SIZING AGENTS IN MANUFACTURE OF PAPER OR BOARD

(71) Applicant: Kemira Oyj, Helsinki (FI)

(72) Inventors: Timo Valkealaakso, Ruutana (FI); Simo-Pekka Vanninen, Espoo (FI); Asko Karppi, Turku (FI)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 16/759,367

(22) PCT Filed: Oct. 31, 2018

(86) PCT No.: PCT/FI2018/050792

§ 371 (c)(1),
(2) Date: Apr. 27, 2020

(87) PCT Pub. No.: WO2019/086761

PCT Pub. Date: May 9, 2019

(65) Prior Publication Data

US 2020/0291581 A1 Sep. 17, 2020

(30) Foreign Application Priority Data

Nov. 1, 2017 (FI) ..... 20175969

(51) Int. Cl.

| | |
|---|---|
| ***D21H 21/16*** | (2006.01) |
| ***D21H 17/16*** | (2006.01) |
| ***D21H 17/17*** | (2006.01) |
| ***D21H 17/37*** | (2006.01) |
| ***D21H 17/62*** | (2006.01) |
| ***D21H 21/10*** | (2006.01) |

(52) U.S. Cl.
CPC ..... *D21H 21/16* (2013.01); *D21H 17/16* (2013.01); *D21H 17/17* (2013.01); *D21H 17/375* (2013.01); *D21H 17/62* (2013.01); *D21H 21/10* (2013.01)

(58) Field of Classification Search
USPC ..... 162/164.1
See application file for complete search history.

(56) References Cited

U.S. PATENT DOCUMENTS

| | | | |
|---|---|---|---|
| 2006/0060814 | A1 | 3/2006 | Pawlowska et al. |
| 2008/0047677 | A1 | 2/2008 | Tamagawa et al. |
| 2008/0277084 | A1 | 11/2008 | Denowski et al. |
| 2010/0000693 | A1 | 1/2010 | Champ et al. |
| 2011/0201748 | A1 | 8/2011 | Pawlowska et al. |
| 2013/0192782 | A1 | 8/2013 | Benz et al. |

FOREIGN PATENT DOCUMENTS

| | | | |
|---|---|---|---|
| CN | 1577116 | A | 2/2005 |
| CN | 101529020 | A1 | 9/2009 |
| JP | 2001117200 | A | 4/2001 |
| RU | 2230846 | C1 | 6/2004 |
| SU | 1703752 | A1 | 1/1992 |
| WO | 0047819 | A1 | 8/2000 |
| WO | 02090206 | A1 | 11/2002 |
| WO | 2004022850 | A1 | 3/2004 |
| WO | 2012007364 | A1 | 1/2012 |
| WO | 2015038901 | A1 | 3/2015 |
| WO | 2016034776 | A1 | 3/2016 |
| WO | 2016120524 | A1 | 8/2016 |
| WO | 2016175299 | A1 | 11/2016 |
| WO | 2017032927 | A1 | 3/2017 |
| WO | 2017116795 | A1 | 7/2017 |

OTHER PUBLICATIONS

Finnish Patent and Registration Office, Search report of FI20175969 dated May 15, 2018, 2 pages.
Polymer Handbook, Fourth Edition, vol. 2, Editors: J. Brandrup, E.H. Immergut and E.A. Grulke, John Wiley & Sons, Inc. USA, 1999, p. VII/11 for poly(acrylamide), 6 pages.
Russian Search Report of Russian Application No. 2020117834, dated Feb. 25, 2022, 6 pages.

*Primary Examiner* — Mark Halpern
(74) *Attorney, Agent, or Firm* — Meunier Carlin & Curfman LLC

(57) ABSTRACT

A method for manufacturing paper or board is disclosed and further disclosed is an internal sizing system for providing improved retention of hydrophobic internal sizing agents. The internal sizing system includes a hydrophobic internal sizing agent as a first component selected from a group consisting of alkenyl succinic anhydride (ASA), alkyl ketene dimer (AKD), rosin sizes and any combination thereof, and a water-soluble polymer product including amphoteric polyacrylamide as a second component, which amphoteric polyacrylamide has neutral or cationic net charge at pH 7, a weight-average molecular weight of 700,000-18,000,000 g/mol and a total ionicity of 4-28 mol-%, where the first component and the second component are provided as separate components or as a combination of the first component and the second component.

20 Claims, No Drawings

POLYMER PRODUCT FOR IMPROVING RETENTION OF HYDROPHOBIC INTERNAL SIZING AGENTS IN MANUFACTURE OF PAPER OR BOARD

PRIORITY

This application is a U.S. national application of the international application number PCT/FI2018/050792 filed on Oct. 31, 2018 and claiming priority of Finnish application 20175969 filed on Nov. 1, 2017 the contents of all of which are incorporated herein by reference.

FIELD OF THE INVENTION

The present invention relates to a manufacture of paper or board and more specifically to paper or board sizing. The invention relates a method for a manufacturing paper or board and to an internal sizing system for providing improved retention of hydrophobic internal sizing agents.

BACKGROUND OF THE INVENTION

Sizing is used during paper or board manufacture to reduce the paper's or board's tendency to absorb liquid. One goal of sizing may also be to allow inks and paints to remain on the surface of the paper or board and to dry there, rather than be absorbed into the paper or board. To reach these goals various sizing agents have been developed and commonly used in the manufacture of paper or board. Sizing agents may be conducted at the wet-end of papermaking process or a suitable coating may be applied on dried paper. Wet-end sizing agents may also have other functionalities than increasing resistance to water penetration only. Wet-end sizing agents may also decrease dusting, control spread of inks, improve dewatering, improve paper quality among other functions.

Sizing at the wet-end of papermaking process uses internal sizing agents. Desired internal sizing agents have some basic characteristics such as high hydrophobicity, good retention on fibres, and uniform distribution throughout the fibre surfaces. Rosin resins are one of the internal sizing agents and effective for acidic papermaking conditions. Alkenyl succinic anhydride (ASA) and alkyl ketene dimer (AKD) have been specifically developed as internal sizing agents for basic or neutral papermaking conditions. ASA reacts with cellulose hydroxyl readily and develops an instant on-machine sizing effect. Fast sizing development achieved with ASA ensures that the application of subsequent surface chemicals remain mostly on the surface of the paper web. AKD reacts relatively slowly with cellulose and the sizing development may take days or weeks after drying.

A controlling of the retention of the internal sizing agents onto fibres is important since otherwise they may accumulate in the process waters and/or form deposition on the process surfaces. Formed deposits may cause quality defects and also web breakages and so affect productivity on paper or board machine. Therefore, methods for improving retention of hydrophobic internal sizing agents are under the continuous interest.

Most paper mills using ASA use cationic starch as emulsifying agent. Cationic starch has been shown to promote ASA sizing efficiency and greater starch dosages will typically lead to higher sizing level. However, starch is often not a desired constituent in papermaking mills because it may lead to excessive biological growth and deposit issues. Therefore, there is a need for solutions which may decrease an amount of the cationic starch used in the sizing while maintaining or even improving the internal sizing efficiency.

In papermaking industry one essential parameter is also cost and adaptability with the existing methods and machinery. Therefore, novel methods for requiring smaller amounts for internal sizing agents and decreasing costs are also under the continuous interest. Any new method should be economic to use and should require only minimal adaptions to the existing systems.

SUMMARY OF THE INVENTION

It is an object of the present invention to reduce or even eliminate the above-mentioned problems appearing in prior art.

An object of the present invention is especially to improve the fixation of the hydrophobic internal sizing agents onto the fibres.

A further object of the present invention to provide a method for manufacturing paper or board which requires smaller amount of the hydrophobic internal sizing agents to provide required $COBB_{60}$ value of the paper of board, i.e. properties to resist penetration and retention of moisture.

These objects are attained with the invention having the characteristics presented below in the characterising parts of the independent claims. Some preferred embodiments of the invention are presented in the dependent claims.

The features recited in the dependent claims and the embodiments in the description are mutually freely combinable unless otherwise explicitly stated.

The exemplary embodiments presented in this text and their advantages relate by applicable parts to the method, the treatment system, the use as well as to the paper or board according to the invention, even though this is not always separately mentioned.

An internal sizing system according to the invention for manufacturing of paper or board comprises

- a hydrophobic internal sizing agent as a first component selected from the group consisting of alkenyl succinic anhydride (ASA), alkyl ketene dimer (AKD), rosin sizes, and any combination thereof, and
- a water-soluble polymer product comprising amphoteric polyacrylamide as a second component, which amphoteric polyacrylamide has neutral or cationic net charge at pH 7, a weight-average molecular weight of 700 000-18 000 000 g/mol and a total ionicity of 4-28 mol-% and which amphoteric polyacrylamide comprises a crosslinker less than 0.002 mol-%, wherein the first component and the second component are provided as separate components or as a combination of the first component and the second component.

A method according to the invention for manufacturing paper or board, where a fibre web is formed from an aqueous suspension of fibres, the method comprising:

- providing an aqueous fibre suspension;
- optionally diluting the aqueous fibre suspension;
- delivering the aqueous fibre suspension to a headbox, draining the aqueous fibre suspension on a wire screen to form a wet web of paper or paperboard, and
- pressing and drying the wet web to obtain a web of paper or board, wherein a hydrophobic internal sizing agent selected from the group consisting of alkenyl succinic anhydride (ASA), alkyl ketene dimer (AKD), rosin sizes, and any combination thereof, and a water-soluble polymer product comprising amphoteric polyacrylamide having neutral or cationic net charge at pH 7, a weight-average molecular weight of 700

000-18 000 000 g/mol and a total ionicity of 4-28 mol-% and comprising a crosslinker less than 0.002 mol-%, are added at least to a fraction of the fibre suspension as a combination or separate components.

According to the present invention, a water-soluble polymer product comprising amphoteric polyacrylamide, which has neutral or cationic net charge at pH 7, a weight-average molecular weight of 700 000-18 000 000 g/mol and a total ionicity of 4-28 mol-% and which amphoteric polyacrylamide comprises a crosslinker less than 0.002 mol-%, is used for improving retention of the hydrophobic internal sizing agents selected from the group consisting of alkenyl succinic anhydride (ASA), alkyl ketene dimer (AKD), rosin sizes, and any combination thereof in manufacture of paper or board, where a fibre web is formed from an aqueous suspension of fibres.

A paper or board product according to the present invention comprising the specified internal sizing system according to the present invention. The paper of board product according to the present invention is preferably obtained by the inventive method or by the inventive use of a specified water-soluble amphoteric polyacrylamide.

Now it has been surprisingly found out that the water-soluble polymer product, which comprises a specified amphoteric polyacrylamide, improves retention of the hydrophobic internal sizing agents to be added to a fibre suspension. The present invention relates also to improved sizing efficiency, which is attributed at least by amphoteric polyacrylamide's ability to improve retention of the hydrophobic internal sizing agents to the paper or board web. A further improvement in sizing efficiency may originate from amphoteric polyacrylamide's ability to improve retention of fines to the paper or board web simultaneously with the hydrophobic internal sizing agents, as these are typically associated with the fines present in the fibre suspension. Further, the improved retention of hydrophobic internal sizing agents and the fines reduces their accumulation in process waters, such as white water. It is assumed that the amphoteric polyacrylamide successfully fixes, i.e. attaches or associates, the hydrophobic internal sizing agent(s) onto the fibres and thus to the paper or board web, thereby also reducing their accumulation and deposition in the process surfaces and/or waters. This may be observed by improved runnability of the paper or board machine since web breakages may be avoided when the internal sizing agents and/or fines are not accumulated in the process waters and/or form deposition on the process surfaces. The improved sizing efficiency may also be attributed by improved shear resistance of the size fixation assisted by the amphoteric polyacrylamide.

The improved fixation of hydrophobic internal sizing agents may even provide improved control of migration of the hydrophobic internal sizing agents in the paper or board, thereby benefiting the sizing performance.

The improved retention achieved by the method according to the invention makes possible to achieve target $Cobb_{60}$ value of the paper or board product with lower amount of the hydrophobic internal sizing agents, whereby significant cost savings is also achieved. By using the amphoteric polyacrylamide, the amount of cationic starch in the hydrophobic internal size formulation may also be reduced or even eliminated, thereby reducing the need for biocides, and improving quality of circulating waters. When cationic starch is used in the hydrophobic internal size formulations, the amphoteric polyacrylamide may provide the additional benefit of improved retention of the cationic starch thereby avoiding its accumulation to the water circulation. In a preferred embodiment of the invention, the paper or board product has at least 5%, preferably at least 8%, more preferably at least 10% lower $Cobb_{60}$ value compared to an otherwise similar paper or board not comprising the second component of the internal sizing system. The paper or board product according to an embodiment of the invention has a predetermined $Cobb_{60}$ value and comprising at least 5%, preferably at least 10%, more preferably at least 15% less of the first component of the internal sizing system, compared to an otherwise similar paper or board having the same predetermined $Cobb_{60}$ value and not comprising the second component of the internal sizing system.

Further, the total ionicity, and especially cationicity, of the specified amphoteric polyacrylamide is moderate or even low, whereby the risk of overcationisation of the paper or board making process is also reduced.

The internal sizing system according to the present invention has been observed to function in a large pH range, both acidic and neutral or alkaline conditions.

DETAILED DESCRIPTION OF THE INVENTION

According to the context of the present application, the term "hydrophobic internal sizing agents" is used to encompass alkenyl succinic anhydride (ASA), alkyl ketene dimer (AKD), rosin sizes, and any combinations thereof.

In the present invention, at least one hydrophobic internal sizing agent is used in combination with a specified amphoteric polyacrylamide.

In the context of the present application the term "amphoteric polyacrylamide" denotes a polyacrylamide where both cationic and anionic units are present in an aqueous solution at pH 7. Amphoteric polyacrylamide is obtained by copolymerisation of acrylamide or methacrylamide together with both anionic and cationic monomers. Preferably amphoteric polyacrylamide is obtained by copolymerisation of acrylamide together with both anionic and cationic monomers.

The term "water-soluble" is understood in the context of the present application that the polymer product, and consequently the amphoteric polyacrylamide, is fully miscible with water. When mixed with excess of water, the amphoteric polyacrylamide in the polymer product is preferably fully dissolved and the obtained polymer solution is preferably essentially free from discrete polymer particles or granules. Excess of water means that the obtained polymer solution is not a saturated solution.

The amphoteric polyacrylamide has neutral or cationic net charge at pH 7. Neutral net charge means that at pH 7 the charges of the anionic and cationic charged units present in the polyacrylamide cancel out each other, whereby the amphoteric polyacrylamide has a neutral net charge. In the net cationic embodiment, the amphoteric polyacrylamide has more cationic charges than anionic charges at pH 7, whereby the amphoteric polyacrylamide has a cationic net charge. According to one embodiment 50-95%, preferably 60-90%, more preferably 70-85%, of the charged units in the amphoteric polyacrylamide are cationic. Thus, according to one preferable embodiment the amphoteric polyacrylamide has a net cationic charge as measured at pH 7. This means that the net charge of the amphoteric polyacrylamide remains positive, even if it contains anionic units. The net charge of the amphoteric polyacrylamide is calculated as the sum of the charges of the cationic and anionic units present. The net cationicity of the amphoteric polyacrylamide provides improved interaction between the amphoteric polyacrylamide and all anionic components present in the fibre suspension, most importantly with fibres. Also, the fixation of the hydrophobic internal sizing agents may be improved, especially when they are associated with the anionic fines present in the fibre suspension.

According to one embodiment the amphoteric polyacrylamide in the polymer product comprises 3-25 mol-%, preferably 3-20 mol-%, more preferably 4-12 mol-%, of structural units derived from cationic monomers. According to one embodiment the amphoteric polyacrylamide in the polymer product comprises 0.5-6 mol-%, preferably 1-5 mol-%, more preferably 1-3 mol-%, of structural units derived from anionic monomers.

The amphoteric polyacrylamide has a weight-average molecular weight of 700 000-18 000 000 g/mol. When the amphoteric polyacrylamide is prepared by gel polymerisation process the weight-average molecular weight of the polyacrylamide is preferably 3 500 000-18 000 000 g/mol. According to one preferable embodiment the amphoteric polyacrylamide has the weight-average molecular weight in the range of 1 000 000-18 000 000 g/mol, preferably 2 500 000-18 000 000 g/mol, more preferably 3 000 000-18 000 000 g/mol, even more preferably 3 500 000-11 000 000 g/mol or 3 500 000-8 000 000 g/mol. The molecular weight of the amphoteric polyacrylamide has an impact on its behaviour and performance. It has been observed that when the weight-average molecular weight of the amphoteric polyacrylamide is 700 000 g/mol or more, preferably 1 000 000 g/mol or more, there is improved fixing of hydrophobic internal sizing agents, to the fibres. By raising the weight-average molecular weight of the amphoteric polyacrylamide, the further improvement of flocculation, retention and drainage may be achieved. However, it has also been observed that when the weight-average molecular weight is at most 18 000 000 g/mol, the fibres are more evenly spaced, there is reduced risk of over-flocculation, so the formation of the web is not disturbed, even with higher polymer dosages. The weight-average molecular weight in the range of 3 500 000-11 000 000 g/mol or 3 500 000-8 000 000 g/mol provides the improvement of flocculation, retention and drainage with the reduced risk of over-flocculation, even at higher dosage levels. This may be also due to the presence of both anionic and cationic charges, so amphoteric polymers are capable of forming loops in papermaking fibre suspension, especially in neutral papermaking pH, thereby preventing too extensive flocculation that could spoil the formation of the formed web.

The amphoteric polyacrylamide may have an intrinsic viscosity in the range of 2.7-27 dl/g, which approximately corresponds a weight-average molecular weight of 700 000-18 000 000 g/mol. According to one preferred embodiment the intrinsic viscosity of the amphoteric polyacrylamide may be in the range of 3.5-27 dl/g, preferably 6.7-27 dl/g, more preferably 7.5-27 dl/g, even more preferably 8.5-19 dl/g, such as 8.5-15.2 dl/g. The intrinsic viscosities reflect the molecule size and may be calculated into weight-average molecular weights as explained hereinafter.

The value "weight-average molecular weight" is in the present context used to describe the magnitude of the polymer chain length. Weight-average molecular weight values are preferably calculated from intrinsic viscosity results measured in a known manner in 1N NaCl at 25° C. by using an Ubbelohde capillary viscometer. The capillary selected is appropriate, and in the measurements of this application an Ubbelohde capillary viscometer with constant K=0.005228 was used. The average molecular weight is then calculated from intrinsic viscosity result in a known manner using Mark-Houwink equation $[\eta]=K\cdot Ma$, where $[\eta]$ is intrinsic viscosity, M molecular weight (g/mol), and K and a are parameters given in Polymer Handbook, Fourth Edition, Volume 2, Editors: J. Brandrup, E. H. Immergut and E. A. Grulke, John Wiley & Sons, Inc., USA, 1999, p. VII/11 for poly(acrylamide). Accordingly, value of parameter K is 0.0191 ml/g and value of parameter "a" is 0.71. The average molecular weight range given for the parameters in used conditions is 490 000-3 200 000 g/mol, but the same parameters are used to describe the magnitude of molecular weight also outside this range. pH of the polymer solutions for intrinsic viscosity determination is adjusted to 2.7 by formic acid to avoid probable poly-ion complexation of amphoteric polyacrylamides.

The amphoteric polyacrylamide has a total ionicity of 4-28 mol-%. According to one preferable embodiment the total ionicity of the amphoteric polyacrylamide is in the range of 4-25 mol-%, preferably 5-20 mol-%, more preferably 6-15 mol-%, even more preferably 6-12 mol-%. The amphoteric polyacrylamide in the polymer product may comprise at least 72 mol-%, preferably at least 75 mol-% structural units derived from acrylamide and/or methacrylamide monomers, and at most 28 mol-%, preferably at most 25 mol-% of structural units originating from anionic and cationic monomers. Total ionicity includes all structural units having ionic charge in the amphoteric polyacrylamide, most of the charged units originating from the ionic monomers but including also other charged units originating from chain termination agents or the like. It has been observed that it is beneficial when the total ionicity of the polymer is at most 20 mol-%, especially when the weight-average molecular weight of the polymer is 700 000-18 000 000 g/mol, or preferably 3 500 000-11 000 000 g/mol. Higher ionicity, especially cationicity, could cause overcationisation when the polymer product is used in increased dosages. Thus, the relatively low ionicity of the amphoteric polyacrylamide enables the use of increased polymer product dosages to fibre suspensions, even if the pulp has a zeta potential values close to zero. The ionicity of the amphoteric polyacrylamide can be optimised in view of avoiding the zeta potential problems in the stock, i.e. shifting of the zeta potential of the pulp to positive values.

According to one preferable embodiment the amphoteric polyacrylamide is a linear polyacrylamide. In other words, the amphoteric polyacrylamide is unbranched and preferably not crosslinked. In the polymerisation the amount of cross-linker is less than 0.002 mol-%, preferably less than 0.0005 mol-%, more preferably less than 0.0001 mol-% for providing a substantially linear amphoteric polyacrylamide. According to one embodiment the polymerisation is completely free of cross-linker. When the amphoteric polyacrylamide comprises less than 0.002 mol-% of crosslinker, the amphoteric polymer dissolves more quickly, and the possibility for insoluble polymer particles after dissolution is effectively reduced. In this way the whole dosage of amphoteric polyacrylamide is effective for flocculation, retention and drainage. Presence of insoluble polymer particles may also reduce the quality of the produced paper or board. Additionally, when the amphoteric polyacrylamide comprises less than 0.002 mol-% of crosslinker, the polymer chains may remain more extended, even when in looped conformation, and/or the charged groups may be more accessible for interactions, thereby improving flocculation and retention.

According to one embodiment the cationic units in the amphoteric polyacrylamide originate from monomers selected from 2-(dimethylamino)ethyl acrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-Cl), 2-dimethylaminoethyl methacrylate dimethylsulphate, [3-(acryloylamino)propyl] trimethylammonium chloride (APTAC), [3-(methacryloylamino)propyl] trimethylammonium chloride (MAPTAC) and diallyldimethyhammonium chloride (DADMAC). Quaternary amines are preferred cationic monomers because their charge is not pH dependent. More preferably the cationic monomer is [2-(acryloyloxy)ethyl] trimethylammonium chloride (ADAM-Cl).

According to one embodiment the anionic units in the amphoteric polyacrylamide originate from monomers selected from unsaturated mono- or dicarboxylic acids or sulphonic acids, preferably from unsaturated monocarboxylic acids or sulphonic acids, such as (meth)acrylic acid, and/or 2-acrylamido-2-methylpropane sulfonic acid (AMPS). While referring to the acid form, it is meant to cover also other forms, such as salt forms of said unsaturated mono- or dicarboxylic acids and sulphonic acids. Most preferably the anionic monomer is acrylic acid or methacrylic acid or salts thereof.

The amphoteric polyacrylamide of the polymer product may be obtained by gel polymerisation. According to one embodiment, this preparation process may use a reaction mixture comprising non-ionic monomers, such as acrylamide, and the charged anionic and cationic monomers. The monomers in the reaction mixture are polymerised in presence of initiator(s) by using free radical polymerisation. The temperature in the beginning of the polymerisation may be less than 40° C., sometimes less than 30° C. Sometimes the temperature in the beginning of the polymerisation may be even less than 5° C. The free radical polymerisation of the reaction mixture produces amphoteric polyacrylamide, which is in gel form or highly viscous liquid. After the gel polymerisation, the obtained amphoteric polyacrylamide in gel form is comminuted, such as shredded or chopped, as well as dried, whereby a particulate polymer product is obtained. Depending on the used reaction apparatus, shredding or chopping may be performed in the same reaction apparatus where the polymerisation takes place. For example, polymerisation may be performed in a first zone of a screw mixer, and the shredding of the obtained polymer is performed in a second zone of the said screw mixer. It is also possible that the shredding, chopping or other particle size adjustment is performed in a treatment apparatus, which is separate from the reaction apparatus. For example, the obtained hydrosoluble, i.e. water-soluble, polymer may be transferred from the second end of a reaction apparatus, which is a belt conveyor, through a rotating hole screen or the like, where it is shredded or chopped into small particles. After shredding or chopping the comminuted polymer is dried, milled to a desired particle size for obtaining polymer product in a particle form and packed for storage and/or transport.

According to one embodiment of the invention the amphoteric polyacrylamide is obtained by gel polymerisation process, where the content of monomers in the reaction mixture at the start of the polymerisation is at least 29 weight-%, preferably at least 30 weight-%, more preferably at least 32 weight-%.

According to one embodiment the amphoteric polyacrylamide content in the polymer product is at least 25 weight-%, preferably at least 60 weight-%. A polymer product having lower polymer content, e.g. obtained by solution polymerisation, has the advantage of easier dilution or dissolution to the concentration of use. A polymer product having a higher polymer content, e.g. obtained by gel polymerisation, emulsion polymer product obtained by emulsion polymerization, optionally dehydrated, or dispersion polymer product obtained by dispersion polymerization, optionally dehydrated, is more cost efficient in view of the logistics of the product. A high polymer content has the additional benefit of improved microbial stability. For example, when the polymer content of the polymer product is at least 60 weight-%, which is typical for a polymer product obtained by gel polymerisation, microbial activity is reduced, and the polymer product is more stable even in warm climate and for long storage periods.

According to one preferable embodiment of the invention the amphoteric polyacrylamide content in the polymer product is in the range of 60-98 weight-%, preferably 70-98 weight-%, more preferably 75-95 weight-%, even more preferably 80-95 weight-%, sometimes even more preferably 85-93 weight-%. Because the amphoteric polyacrylamide content of the polymer product may be high, naturally the amount of active amphoteric polyacrylamide is also high. This has a positive impact on transport and storage costs of the polymer product. Moisture content of the polymer product is typically 5-12 weight-%.

According to one preferable embodiment the polymer product comprising amphoteric polyacrylamide is in particle form. In the context of the present application the term "particle form" denotes discrete solid particles or granules. According to one embodiment of the invention the polymer product comprises particles or granules of amphoteric polyacrylamide, which have an average particle size of <2.5 mm, preferably <2.0 mm, more preferably <1.5 mm. These particles are obtained by subjecting the amphoteric polyacrylamide obtained by gel polymerisation to mechanical comminution, such as cutting, milling, shredding, chopping or the like.

According to one embodiment of the present invention the solids content of the polymer product in particle form may be >80 weight-%, preferably >85 weight-%, more preferably in the range of 80-97 weight-%, even more preferably 85-95 weight-%. The high solids content is beneficial in view of storage and transport properties of the polymer product.

When used, the water-soluble polymer product comprising the amphoteric polyacrylamide is usually dissolved into water and/or diluted, whereby an aqueous treatment solution is obtained. As used herein, by dissolving in water to obtain an aqueous treatment solution, it is meant to cover both dissolving and diluting. The amphoteric polyacrylamide content of the said aqueous treatment solution may be 0.1-4 weight-%, preferably 0.3-3 weight-%, more preferably 0.5-2 weight-%. According to one embodiment the water-soluble polymer product comprising amphoteric polyacrylamide is dissolved in water having pH 2.5-6.5, preferably 2.5-6, such as 2.5-5.5, more preferably 2.5-5 to obtain the aqueous treatment solution of the polymer product comprising amphoteric polyacrylamide. The suitable pH may be adjusted e.g. by adding an acid, or base. Using this slightly acidic pH in polymer dissolution the amphoteric polyacrylamide maintains its full functionality. Additionally, using this pH range some undesired effects on the hydrophobic internal sizing agent, such as hydrolysis thereof, may be avoided or slowed down, especially when the hydrophobic internal sizing agent is emulsified and/or stabilized with the amphoteric polyacrylamide. In this respect the pH value of the hydrophobic internal sizing agent emulsion, especially of ASA emulsion, is advantageously in the range of 3-6, preferably 3-5, more preferably 3-4.

According to the present invention, the hydrophobic internal sizing agent is selected from the group consisting of alkenyl succinic anhydride (ASA), alkyl ketene dimer (AKD), rosin sizes, and any combination thereof. In a preferred embodiment of the invention, a hydrophobic internal sizing agent is alkenyl succinic anhydride (ASA).

An internal sizing system according to an embodiment of the present invention comprises a water-soluble polymer product and a hydrophobic internal sizing agent in a weight ratio of 1:15-1.5:1, preferably 1:10-1:2. Higher amounts of the water-soluble polymer product are not expected to be cost-efficient and to provide substantial further benefit in internal sizing, and lower amounts may be inadequate for achieving the desired sizing specifications.

According to the invention the polymer product comprising a specified amphoteric polyacrylamide is used for improving retention of the hydrophobic internal sizing agent (s). An internal sizing system according to the present invention comprises a hydrophobic internal sizing agent as a first component and a polymer product comprising a specified amphoteric polyacrylamide as a second component, wherein the first component and the second component are provided as separate components, or as a combination of the first component and the second component. According to the invention at least one hydrophobic internal sizing agent and the polymer product comprising a specified amphoteric polyacrylamide are added to the fibre suspension separately or a combination of them. In the context of the present application the combination of the components may refer to a mixture of the components, or simultaneous addition of the components to a fibre suspension, or a combination in which a first component is emulsified and/or stabilized with a second component. The embodiments of the invention are disclosed more detailed below.

An addition point, a way of the addition and the amounts to be added are dependent on e.g. the hydrophobic internal sizing agent, paper or board to be manufactured and fibre suspension.

In the present context, rosin resins refer to various types of the rosin sizes, such as tall oil rosin and gum rosins. Examples of rosin resins include fortified rosin sizes, such as rosins at least partially reacted with maleic anhydride and/or fumaric acid, and cationic rosin sizes, such as rosin soap sizes. The rosin resins are typically available in a usable form. Also, AKD is typically available in a usable dispersion. Whereas ASA has to be emulsified on-site due to its high reactivity by using a separate emulsifying equipment and it is typically used directly without any intermediate storage.

A hydrophobic internal sizing agent may be formulated, i.e. emulsified and/or stabilized with cationic starch, a specified amphoteric polyacrylamide according to the invention (a second component of the internal sizing system) or any combination of them. Also, other polymers, such as polyamine may be used.

According to an embodiment of the invention, a first component, i.e. a hydrophobic internal sizing agent may be formulated with cationic starch, i.e. a hydrophobic internal sizing agent may be emulsified and/or stabilized with cationic starch. ASA is usually emulsified and stabilized with cationic starch at the paper mill just prior dosage, wherein a cationic starch is used as an emulsifying agent. The obtained ASA emulsion may be added to a fibre suspension. AKD and rosin resins are typically stabilized with cationic starch, earlier at chemical mill since they can be stored and delivered in the stabilized form. Correspondingly, the obtained AKD and rosin resin dispersions or emulsions may be added to a fibre suspension. A dosage point may depend on the manufacturing process and the paper or board to be manufactured.

According to an embodiment of the present invention the combination of the first and a second component has formed by emulsifying the first component, i.e. a hydrophobic internal sizing agent with the aqueous treatment solution of the second component. All cationic starch or at least part of a cationic starch may be replaced with the treatment solution of the polymer product comprising amphoteric polyacrylamide. According to an embodiment of the invention, an amount of the amphoteric polyacrylamide may be 5-40 weight-%, preferably 15-20 weight-% of the hydrophobic internal sizing agent, calculated as dry. When a part of cationic starch is replaced by the treatment solution of the polymer product comprising amphoteric polyacrylamide, then a dose of the amphoteric polyacrylamide may be e.g. 3-20 weight-% of the hydrophobic internal sizing agent, calculated as dry. If starch is replaced with the amphoteric polyacrylamide, the formulation is less vulnerable to microbial degeneration, and also less starch ends up into circulating waters of the papermaking system. Also in this embodiment, ASA is emulsified and stabilized at the paper mill just prior dosage, whereas AKD and rosin resins may be formulated already earlier at chemical mill. The obtained emulsion or dispersion may be added to a fibre suspension.

In one preferred embodiment of the invention the internal sizing system is a combination of the alkenyl succinic anhydride (ASA) and a polymer product comprising specified amphoteric polyacrylamide, which combination has formed by emulsifying ASA with the aqueous treatment solution of the polymer product comprising amphoteric polyacrylamide. In this embodiment ASA is emulsified with the aqueous treatment solution of the polymer product comprising amphoteric polyacrylamide instead of a cationic starch or at least part of the cationic starch is replaced with the aqueous treatment solution of the polymer product comprising amphoteric polyacrylamide as disclosed above. In that case, both ASA and the amphoteric polyacrylamide are present in the emulsion of the ASA to be added to the fibre suspension. In this embodiment, no separate addition of the aqueous treatment solution of the polymer product comprising amphoteric polyacrylamide is required, but it is possible to add separately a hydrophobic internal sizing agent, such as ASA formulated with the amphoteric polyacrylamide and the aqueous treatment solution of the polymer product comprising amphoteric polyacrylamide to a fibre suspension.

A viscosity of the cationic starch or the aqueous treatment solution of the second component to be usable for formulating, i.e. emulsifying and/or stabilizing sizing agent is at most 250 mPas, preferably at most 200 mPas and more preferably in the range of 100-200 mPas. According to an embodiment of the invention the suitable viscosity may be achieved when the content of the amphoteric polyacrylamide in said treatment solution is in the range of 0.7-1.0 weight-%.

According to one preferred embodiment of the invention, ASA is emulsified with cationic starch and the obtained ASA emulsion is combined with an aqueous treatment solution of the polymer product comprising amphoteric polyacrylamide prior to addition in to fibre suspension or they are added separately to fibre suspension.

When ASA is emulsified in cationic starch, cationic starch and ASA may be present in a weight ratio of 1:1-2:1 (dry/dry).

In another embodiment according to the present invention for manufacturing a paper of board, an aqueous treatment solution of the polymer product comprising amphoteric polyacrylamide and a hydrophobic internal sizing agent are added separately to a fibre suspension. They may be added sequentially or simultaneously but separately. In a typical method, they are added to the fibre suspension in different points of the manufacturing process.

The aqueous treatment solution of the polymer product comprising amphoteric polyacrylamide may be added to the thick stock as a wet end chemical or it may be added to a thin stock. Thick stock is here understood as a fibrous stock or furnish, which has consistency of above 20 g/l, preferably more than 25 g/l, more preferably more than 30 g/l. According to one embodiment the aqueous treatment solution of the polymer product comprising amphoteric polyacrylamide is added to fibre suspension having consistency of above 20 g/l. According to one embodiment, the addition of the treatment solution of the polymer product comprising amphoteric polyacrylamide is located after the stock storage towers, but before thick stock is diluted in the wire pit (off-machine silo) with short loop white water. Preferably the treatment solution of the polymer product comprising amphoteric polyacrylamide is added to the fibre suspension before a machine chest, more preferably before a mixing chest, of a paper or board machine. In an embodiment of the invention at least part of the amphoteric polyacrylamide is added to the fibre suspension having consistency of above 20 g/l.

The treatment solution of the polymer product comprising amphoteric polyacrylamide may also be added to a thin stock, i.e. after the point of thick stock dilution, similarly as conventional retention polymers. The treatment solution may be added to a thin stock at any point before a headbox of the paper or board machine. In an embodiment, at least part of the amphoteric polyacrylamide is added to the fibre suspension close to a head box, before or after a (pressure) screen of the paper or board machine. An amount of the amphoteric polyacrylamide to be added may be remarkably lower when it is added close to a headbox compared to an addition into the thick stock.

In an embodiment an aqueous treatment solution of the polymer product comprising amphoteric polyacrylamide is added sequentially so that at least part of the treatment solution is added to the fibre suspension having consistency of above 20 g/l and last part is added to a thin stock.

According to the invention, a hydrophobic internal sizing agent may also be added to a thin stock or a thick stock at any suitable point.

In an embodiment of the invention both a hydrophobic internal sizing agent and an aqueous treatment solution of the polymer product comprising amphoteric polyacrylamide may be added to a fibre suspension before dilution of the fibre suspension. It is believed that this embodiment achieves further improved sizing performance due to enhanced interactions between the fibres and the hydrophobic internal sizing agent and the amphoteric polyacrylamide at the higher consistency. In another embodiment of the invention an aqueous treatment solution of the polymer product comprising amphoteric polyacrylamide may be added into thick stock just before dilution and a hydrophobic internal sizing agent thereafter either to thick stock or thin stock.

In one preferred embodiment, an aqueous treatment solution of the polymer product comprising amphoteric polyacrylamide and a hydrophobic internal sizing agent are added separately close to each other, i.e. within short intervals. It is believed that this embodiment achieves further improved sizing performance because of improved interaction between the closely added components.

In an embodiment according to the invention, at least part of the aqueous treatment solution of the water-soluble polymer product is added to a fraction of the fibre suspension comprising a broke suspension after a broke tower and prior to a thickener for broke suspension, and the thickened broke suspension is combined with other fractions of the fibre suspension. When broke fraction to be added to the fibre suspension is treated with an aqueous treatment solution of the polymer product comprising amphoteric polyacrylamide before a broke thickener, a thickened broke suspension may comprise more fines with which a hydrophobic internal sizing agent added afterwards may associate. This may further improve an internal sizing effect. Consequently, also turbidity and/or hydrophobics content and/or anionic trash content in the filtrate from the thickener may be decreased, thereby improving the overall quality of circulating waters in the whole papermaking process. In addition, an internal sizing effect may be further improved by adding an aqueous treatment solution of the polymer product comprising amphoteric polyacrylamide also after a broke tank and/or to a thin stock, wherein a retention of fines is more efficient and may comprise more the associated internal sizing agent.

It has been observed that in an embodiment, where a hydrophobic internal sizing agent is added first to a fibre suspension and then an aqueous treatment solution of the polymer product comprising amphoteric polyacrylamide, sizing performance, e.g. $Cobb_{60}$ value of the paper or board product may be improved significantly. It is believed that in this embodiment, a part of the hydrophobic internal sizing agent is retained on fibres, and the non-retained part interacts with fines and fillers that the amphoteric polyacrylamide then further retains on the fibres. In another embodiment a hydrophobic internal sizing agent may be dosed to thick stock just before dilution, and an aqueous treatment solution of amphoteric polyacrylamide may be dosed to thin stock before pressure screen. It has been observed that sizing performance, e.g. $Cobb_{60}$ value of the paper or board product may be improved also by this sequence. Yet in another preferred embodiment a hydrophobic internal sizing agent and at least part of an aqueous treatment solution of polymer product comprising amphoteric polyacrylamide are added to a fibre suspension having consistency of above 20 g/l, and at least part of the aqueous treatment solution is added to the aqueous fibre suspension after dilution into thin stock. It is believed that this embodiment achieves further improved sizing performance, e.g. lower $Cobb_{60}$ value of the paper or board product, as the first part(s) of the amphoteric polyacrylamide may assist in retaining and fixing to the fibres major part of the hydrophobic internal sizing agent, while the subsequent part(s) of the amphoteric polyacrylamide may assist in retaining and fixing to the fibres any remaining hydrophobic internal sizing agent, whether present as free, or bound e.g. to the fines and fillers present in the fibre suspension.

In some embodiments, a paper or board comprising the internal sizing system or manufactured according to the present invention may have at least 5%, preferably at least 8%, more preferably at least the 10% lower $Cobb_{60}$ value compared to an otherwise similar paper or board not comprising the second component of the internal sizing system.

In some embodiments, a paper or board having a predetermined $Cobb_{60}$ value and comprising the internal sizing system or manufactured according to the present invention, may comprise at least 5%, preferably at least 10%, more preferably at least 15% less of the first component of the internal sizing system, compared to an otherwise similar paper or board having the same predetermined $Cobb_{60}$ value but not comprising the second component of the internal sizing system. As used herein, by $Cobb_{60}$ values are meant values measured according to ISO 535, T441, using e.g. L&W Cobb Sizing Tester.

In a further embodiment of the invention, an emulsion or dispersion of the hydrophobic internal sizing agent is combined with an aqueous treatment solution of the polymer product comprising amphoteric polyacrylamide prior to addition to fibre suspension. It is believed that this achieves further improved sizing performance due to better interaction between the internal sizing agent and the amphoteric polyacrylamide assisting in its retention and fixing to the fibres. The combining may be simply carried out by mixing a separate solutions or streams of an aqueous treatment solution of the polymer product comprising amphoteric polyacrylamide and a hydrophobic internal sizing agent. In an embodiment, a hydrophobic internal sizing agent is formulated with a cationic starch and the obtained emulsion is combined with an aqueous treatment solution of the polymer product comprising amphoteric polyacrylamide prior to addition to fibre suspension. Typical dosage point of the combination of the amphoteric polyacrylamide and the hydrophobic sizing agent may depend on the manufacturing process and the paper or board to be manufactured.

An amount of the polymer product comprising amphoteric polyacrylamide to be added may depend on the hydrophobic internal sizing agent which is used in combination with it. A dosage amount of the polymer product comprising amphoteric polyacrylamide is typically in the range of 0.1-1.5 kg (dry)/ton paper or board, or preferably 0.2-1 kg (dry)/ton paper or board. In an embodiment according to the invention, in which at least part of the polymer product comprising amphoteric polyacrylamide is added to a fraction of the fibre suspension comprising broke prior to combining the broke fraction with other fractions of the fibre suspension, a dosage amount of the polymer product to be added to the broke fraction may be 0.05-0.3 kg (dry)/ton paper or board. Further, the polymer product may also be added about 0.1-0.2 kg (dry)/ton paper or board to a thickened broke suspension prior to combining it with other fractions of the fibre suspension.

Typically, different internal sizing agents require different dosage amounts. An amount of ASA to be added may be in the range of 0.2-5 kg (dry)/ton paper or board, preferably 0.7-3 kg (dry)/ton paper or board. An amount of AKD to be added may be in the range of 0.2-4 kg (dry)/ton paper or board, preferably 0.7-2 kg (dry)/ton paper or board. An amount of rosin resin to be added may be in the range of 0.5-10 kg (dry)/ton paper or board, preferably 1.5-3 kg (dry)/ton paper or board.

A fibre suspension may be any kind of fibre suspension. In the present context, and as used above, the term "fibre suspension" is understood as an aqueous suspension, which comprises fibres, preferably recycled fibres, and optionally fillers. The water-soluble polymer product comprising amphoteric polyacrylamide is especially suitable for manufacture of paper and/or board grades having an ash content before coating, if any, of >10%, preferably >15%, more preferably >20%. Standard ISO 1762, temperature 525° C. is used for ash content measurements. For example, the fibre suspension may comprise at least 5%, preferably 10-30%, more preferably 11-19% of mineral filler. The amount of mineral filler is calculated by drying the fibre suspension, and the ash content is measured by using standard ISO 1762, at temperature 525° C. Mineral filler may be any filler conventionally used in paper and board making, such as ground calcium carbonate, precipitated calcium carbonate, clay, talc, gypsum, titanium dioxide, synthetic silicate, aluminium trihydrate, barium sulphate, magnesium oxide or any of their combinations.

An internal sizing system of the invention performs over a broad pH range of the fibre suspension. A pH of the fibre suspension may be e.g. 4-10, but typically pH is in the range of 5-8. While the optimum pH range for each hydrophobic internal sizing agent may be narrower, it is believed that due to the improved retention and fixing provided by the specified amphoteric polyacrylamide, the usable pH ranges of each sizing agent may be broadened.

In an embodiment of the invention the fibre suspension may comprise recycled fibre material. According to one embodiment the fibre suspension comprises at least 50 weight-%, preferably at least 60 weight-%, more preferably at least 70 weight-%, of recycled fibre material, based on dry paper or paperboard. In some embodiments the fibre suspension may comprise even >80 weight-%, or 100 weight-%, of fibres originating from recycled fibre materials.

According to one embodiment the fibre suspension has a conductivity of at least 1.5 mS/cm, preferably at least 2.0 mS/cm, more preferably at least 3.0 mS/cm, measured at the headbox of the paper or board machine. Elevated conductivity is typical for fibre suspension comprising recycled fibres and/or closed papermaking process. The polymer product comprising amphoteric polyacrylamide can be used even at elevated conductivity, without significant decrease in effectivity in retention of the hydrophobic internal sizing agents.

An internal sizing system according to the present invention performs also over wide anionic charge range of the fibre suspension, even close to zero where typical cationic additives may cause overcationization and foaming. Typical performance range may be −0.1-−1.5 meq/L of the fibre suspension, but the internal sizing system according to the present invention performs well even at fibre suspension having anionic charge of −15 meq/L, such as in neutral sulfite semi-chemical pulp. The anionic charge of the fibre suspension may be measured by Mütek Particle Charge Detector.

According to one embodiment of the invention the fibre suspension comprises fibres obtained by kraft and/or mechanical pulping process(es). In one preferred embodiment, a fibre suspension may be unbleached kraft or mechanical pulp. In these fibre suspension, particularly good performance of the internal sizing system according to the present invention has been observed compared to conventional sizing systems, which may be due to the inherent high load of colloidal material and interfering substances of these fibre suspensions that the present sizing system is able to control. An internal sizing system according to the invention performs even in 100 weight-% unbleached kraft and/or mechanical or CTMP fibre suspension. According to an embodiment of the invention a fibre suspension may comprise kraft and recycled fibre material in a weight ratio of 50:50.

According to one embodiment an internal sizing system is used for improving retention of the hydrophobic internal sizing agents in manufacture of paper or board. The board may be selected from liner, fluting, gypsum board liner, wall paper, core board, folding boxboard (FBB), white lined chipboard (WLC), solid bleached sulphate (SBS) board, solid unbleached sulphate (SUS) board or liquid packaging board (LPB) such as cup stock. The boards may be based 100% on primary fibres, 100% on recycled fibres, or to any possible blend between the primary fibres and the recycled fibres. An internal sizing system according to the invention is also suitable for use in manufacturing of fine paper grades; both uncoated and coated fine paper.

An internal sizing system and a method according to the invention is also suitable for multi-layered board production. By multi-layered board production is meant production of board comprising at least two layers of fibres. Such multi-layered board may be manufactured by delivering aqueous fibre suspension to a multi-layer headbox, draining the aqueous fibre suspension on a wire screen to form a wet web of paper or paperboard, and pressing and drying the wet web to obtain a multi-layered web of board. Alternatively, the multi-layered board may be manufactured by delivering aqueous fibre suspension(s) to at least two headboxes, draining the aqueous fibre suspension(s) on at least two wire screens to form wet webs of paper or paperboard, interposing the wet fibre webs, and pressing and drying the interposed wet web to obtain a multi-layered web of board. In the multi-layered products, an internal sizing system according to the invention comprising amphoteric polyacrylamide and hydrophobic internal sizing agent are typically added to same fibre suspension forming one or more of the layers of the multi-layered board product. The one or more layers may be a middle layer or any of the surface layers of the product. According to an embodiment of the invention amphoteric polyacrylamide and hydrophobic internal sizing agent are added to all layers.

EXPERIMENTAL

Some embodiments of the invention are described in the following non-limiting examples.

Polymer Example: General Description of the Polymer Product Preparation

Preparation of Monomer Solution for the Amphoteric Polyacrylamide

Monomer solution is prepared by mixing 248.3 g of 50% acrylamide solution, 0.01 g of 40% DTPA Na-salt solution, 2.9 g of sodium gluconate, 4.4 g of dipropylene glycol, 1.9 g of adipic acid, and 7.2 g of citric acid in a temperature controlled laboratory glass reactor at 20-25° C. The mixture is stirred until solid substances are dissolved. To the solution is added 32.6 g of 80% ADAM-Cl. pH of the solution is adjusted to 3.0 with citric acid, and 2.8 g of acrylic acid is added to the solution. pH is adjusted to be 2.5-3.0.

Preparation of Dry Polymer Product

After the monomer solution is prepared according to the above description, the monomer solution is purged with nitrogen flow in order to remove oxygen.

An initiator is added to the monomer solution. The initiator solution is 4 ml of 6% 2-hydroxy-2-methylpropiophenone in polyethylene glycol-water (1:1 by weight) solution. The monomer solution is placed on a tray to form a layer of about 1 cm under UV-light. UV-light is mainly on the range 350-400 nm, for example light tubes Philips Actinic BL TL 40W can be used. Intensity of the light is increased as the polymerisation proceeds to complete the polymerisation. The first 10 minutes the light intensity is 550 $\mu W/cm^2$, and following 30 minutes it is 2000 $\mu W/cm^2$. The obtained gel is run through an extruder and dried to moisture content less than 10% at temperature of 60° C. The dried polymer is ground and sieved to particle size 0.5-1.0 mm.

Intrinsic viscosity of the polymer product was determined by Ubbelohde capillary viscometer in 1 M NaCl at 25° C. Polymer product was dissolved in 1 M NaCl and a series of dilutions at suitable concentrations ranging from 0.01 to 0.5 g/dl for viscosity determinations. pH of the polymer solution for capillary viscosity determination was adjusted to 2.7 by formic acid to avoid impact of probable polyion complexation for viscosity. Molecular weights were calculated using "K" and "a" parameters of polyacrylamide. The value of parameter "K" is 0.0191 ml/g and the value of parameter "a" is 0.71. Determined intrinsic viscosity was 9.9 dl/g and calculated molecular weight 4 400 000 g/mol.

The obtained polymer product comprising amphoteric polyacrylamide containing 7 mol-% ADAM-Cl, 2 mol-% acrylic acid and 91 mol-% acrylamide is used in the following Application Examples.

Application Example 1

ASA retention in liquid packaging board machine is investigated in laboratory. An aqueous treatment solution of the polymer product comprising amphoteric polyacrylamide is combined with ASA-starch (starch use herein is cationic starch) emulsion before introducing to a fibre suspension. As references, ASA-starch emulsion is used without co-addition of any synthetic polymer, and with co-addition of a conventional cationic inorganic coagulant polyaluminium chloride (PAC), and a cationic glyoxylated polymer (GPAM). The GPAM used is charge density of about 1.8 meq/g (dry).

Laboratory method:

Bleached chemical pulp is taken from a 2-ply board machine chest of the top ply and diluted to 1 weight-% with clear filtrate water to obtain a pulp sample. Pulp sample amount is 300 ml. 9 ml of ASA-starch emulsion is taken with 20 ml syringe. 0.1 weight-% dry content polymer solutions (dosage level 330 g/t as dry) are added to syringe and mixed in the syringe. Mixture of ASA-starch emulsion and polymer is added to 300 ml fibre suspension sample. After chemical addition fibre sample is mixed 60 s with lab mixer at 700 rpm. After mixing sample is vacuum filtered with Buchner (diameter ~15 cm) included 400 μm polymer wire. Sample filtrate (20 μl) is diluted with distilled water (980 μl) and fluorescent colouring agent (20 μl) is added. Flow cytometric measurement is carried out for diluted sample filtrates using SL Blue device supplied by Partec GmbH. Also sample of ASA-starch emulsion without fibre suspension is measured, to identify the location of ASA-particle population in the measurement data. The amount of total hydrophobic particles and ASA-particles are measured and calculated from diluted filtrate samples. The results are presented in Table 1.

TABLE 1

The amount of unretained total hydrophobics and ASA-particles in sample filtrates.

| Size emulsion and co-additive used | Total unretained hydrophobic particles, count/ml | Reduction-% of total hydrophobics compared to Ref. | Unretained ASA particles, count/ml | Reduction-% of ASA compared to Ref. |
|---|---|---|---|---|
| Ref. (ASA-starch) | 6534500 | n.a. | 1037000 | n.a. |
| ASA-starch + PAC | 5400500 | 17% | 987000 | 4.8% |
| ASA-starch + GPAM | 4678250 | 28% | 770750 | 26% |
| ASA-starch + amphoteric PAM | 3961500 | 39% | 172750 | 83% |

Application Example 2

In this example a 2-layer Fourdrinier machine producing liner paper is run with ASA addition of 2.5 kg/t paper to base ply thick stock into machine chest, the stock comprising unbleached kraft and OCC in weight ratio of 50:50. Thereafter amphoteric polyacrylamide as specified in the claims is added to the base ply thick stock, to the outlet of the machine chest, in amounts of 0.3-0.6 kg/t paper, while continuing the same ASA dosage. As a result, $Cobb_{60}$ value is improved from 29 to 22 g/m$^2$ as shown in Table 2.

Chemicals in base ply thick stock and dosage point:

ASA size 2.5 kg/t, machine chest

Cationic starch 5 kg/t, machine chest

Alum 3 kg/t, machine chest

Retention grade CPAM and silica, before and after screen

Wet end conditions in base ply are pH 7, conductivity 2500 μS/cm, anionic charge −350 μekv/l, and zeta potential −10 mV.

TABLE 2

$Cobb_{60}$ improvement with different dosages of the specified amphoteric polyacrylamide

| Machine reel | Amphoteric polyacrylamide kg/t | $Cobb_{60}$, g/m$^2$ |
|---|---|---|
| 1 | 0 | 29 |
| 2 | 0.3 | 27 |
| 3 | 0.45 | 26 |
| 4 | 0.6 | 24 |
| 6 | 0.6 | 23 |
| 8 | 0.6 | 22 |
| 9 | 0 | 26 |

Application Example 3

In this example a 2-layer 1 fourdrinier machine producing kraftliner from 100% unbleached kraft fibres is run with ASA addition to thick stock providing to the paper a target $Cobb_{60}$ value. Thereafter amphoteric polyacrylamide as specified in the claims is started to be added to thick stock. Paper's $Cobb_{60}$ value is monitored and ASA dosage is decreased to maintain the target $Cobb_{60}$ value. Target $Cobb_{60}$ value is steady with 25-30% lower ASA dosage, compared to not using the amphoteric polyacrylamide.

Application Example 4

In this example folding box board is produced using CTMP and broke in the middle ply furnish. ASA is added to middle ply furnish, pH 7, providing to the board a target $Cobb_{60}$ value. Thereafter amphoteric polyacrylamide as specified in the claims is added 200-400 g/t board to thin stock before pressure screen. Board's $Cobb_{60}$ value is monitored and ASA dosage decreased to maintain the target $Cobb_{60}$ value. Target $Cobb_{60}$ value is steady with 12% lower ASA dosage, compared to not using the amphoteric polyacrylamide. At the same time less deposits are observed on the machinery, resulting in improved runnability.

The invention claimed is:

1. A method for manufacturing paper or board, where a fibre web is formed from an aqueous suspension of fibres, the method comprising:

providing an aqueous fibre suspension;

optionally diluting the aqueous fibre suspension;

delivering the aqueous fibre suspension to a headbox, draining the aqueous fibre suspension on a wire screen to form a wet web of paper or paperboard;

pressing and drying the wet web to obtain a web of paper or board;

wherein an internal sizing system is added at least to a fraction of the fibre suspension, the internal sizing system comprising a hydrophobic internal sizing agent as a first component selected from a group consisting of alkenyl succinic anhydride (ASA), alkyl ketene dimer (AKD), rosin sizes and any combination thereof, and a water-soluble polymer product comprising amphoteric polyacrylamide as a second component, which amphoteric polyacrylamide has neutral or cationic net charge at pH 7, a weight-average molecular weight of 3,500,000-18,000,000 g/mol and a total ionicity of 4-28 mol-%, and which amphoteric polyacrylamide comprises a crosslinker less than 0.002 mol-%, and wherein the first component and the second component are provided as separate components or as a combination of the first component and the second component.

2. The method according to claim 1, wherein the water-soluble polymer product comprising amphoteric polyacrylamide is dissolved in water to obtain an aqueous treatment solution, which has a pH value of 2.5-6.5.

3. The method according to claim 2, wherein the first component is formulated with a cationic starch, the second component or any combination of them.

4. The method according to claim 3, wherein a viscosity of the cationic starch or the aqueous treatment solution of the second component is at most 250 mPas.

5. The method according to claim 2, wherein the combination of the first and the second component is formed by emulsifying the first component with the aqueous treatment solution of the second component.

6. The method according to claim 2, wherein the first component and the aqueous treatment solution of the second component of the internal sizing system are added separately to the fibre suspension, or the first component and the aqueous treatment solution of the second component of the internal sizing system are combined prior to addition into the fibre suspension.

7. The method according to claim 2, wherein at least part of the aqueous treatment solution of the second component is added to a fraction of the fibre suspension comprising a broke suspension after a broke tower and prior to a broke thickener, and the thickened broke is combined with other fractions of the fibre suspension.

8. The method of claim 1, wherein the amphoteric polyacrylamide has a weight-average molecular weight in a range of 3,500,000-11,000,000 g/mol.

9. The method of claim 1, wherein the total ionicity of the amphoteric polyacrylamide is in a range of 5-20 mol-%.

10. The method of claim 1, wherein the amphoteric polyacrylamide in the polymer product comprises 3-25 mol-% of structural units derived from cationic monomers, and 0.5-6 mol-% of structural units derived from anionic monomers.

11. The method of claim 1, wherein 50-95% of the charged units in the amphoteric polyacrylamide are cationic.

12. The method of claim 1, wherein the amphoteric polyacrylamide has a net cationic charge as measured at pH 7.

13. The method of claim 1, wherein the amphoteric polyacrylamide is a linear polyacrylamide.

14. The method of claim 1, wherein cationic units of the amphoteric polyacrylamide originate from monomers selected from 2-(dimethylamino)ethyl acrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-Cl), 2-dimethylaminoethyl methacrylate dimethylsulphate, [3-(acryloylamino)propyl] trimethylammonium chloride (APTAC), [3-(methacryloylamino)propyl] trimethylammonium chloride (MAPTAC) and diallyldimethyl ammonium chloride (DADMAC).

15. The method according to claim 1, wherein anionic units of the amphoteric polyacrylamide originate from monomers selected from unsaturated mono- or dicarboxylic or sulphonic acids.

16. The method according to claim 1, wherein the polymer product has a polymer content of at least 25 weight-%.

17. The method according to claim 1, wherein the internal sizing system comprises a water-soluble polymer product and a hydrophobic internal sizing agent in a weight ratio of 1:15-1.5:1.

18. The method according to claim 1, wherein the aqueous fibre suspension is delivered to a multilayer headbox or at least two headboxes, wherein a multi-layered web of board is obtained, and one or more layers of the multi-layered board comprises the internal sizing system.

19. An internal sizing system for manufacturing paper or board, which comprises:

a hydrophobic internal sizing agent as a first component selected from a group consisting of alkenyl succinic anhydride (ASA), alkyl ketene dimer (AKD), rosin sizes and any combination thereof, and a water-soluble polymer product comprising amphoteric polyacrylamide as a second component, which amphoteric polyacrylamide has neutral or cationic net charge at pH 7, a weight-average molecular weight of 3,500,000-18,000,000 g/mol and a total ionicity of 4-28 mol-% and which amphoteric polyacrylamide comprises a crosslinker less than 0.002 mol-%, wherein the first component and the second component are provided as separate components or as a combination of the first component and the second component.

20. A paper or board product comprising an internal sizing system according to claim 19.

* * * * *